US008480189B2

(12) United States Patent
Katz et al.

(10) Patent No.: US 8,480,189 B2
(45) Date of Patent: Jul. 9, 2013

(54) CABINET WITH OFFSET HINGE

(75) Inventors: Howard S. Katz, Riegelsville, PA (US); James L. Stanley, Jr., Levittown, PA (US)

(73) Assignee: Robern, Inc., Bristol, PA (US)

( * ) Notice: Subject to any disclaimer, the term of this patent is extended or adjusted under 35 U.S.C. 154(b) by 88 days.

(21) Appl. No.: 12/965,634

(22) Filed: Dec. 10, 2010

(65) Prior Publication Data

US 2012/0146470 A1 Jun. 14, 2012

(51) Int. Cl.
*A47B 67/00* (2006.01)

(52) U.S. Cl.
USPC ..... 312/227; 312/242

(58) Field of Classification Search
USPC ..... 312/209, 224, 225, 226, 227, 326, 312/327, 328, 329, 242, 245
See application file for complete search history.

(56) References Cited

U.S. PATENT DOCUMENTS

| | | | | | |
|---|---|---|---|---|---|
| 1,758,843 | A * | 5/1930 | Lizotte | 403/219 |
| 1,802,552 | A * | 4/1931 | Corcoran | 292/166 |
| 2,678,252 | A | 5/1954 | Swearingen | |
| 2,883,254 | A | 4/1959 | Bacca | |
| 4,134,625 | A * | 1/1979 | Palka | 312/206 |
| 4,209,212 | A * | 6/1980 | McGoldrick | 312/245 |
| 4,239,310 | A | 12/1980 | Benjamin | |
| 4,304,447 | A * | 12/1981 | Ellwood et al. | 312/204 |
| 4,867,511 | A | 9/1989 | Katz | |
| 5,164,861 | A | 11/1992 | Katz | |
| 5,355,627 | A | 10/1994 | Katz | |
| 5,368,378 | A | 11/1994 | Curtis | |
| 5,511,873 | A | 4/1996 | Mech | |
| 5,624,170 | A * | 4/1997 | Hasty | 312/329 |
| 6,049,946 | A * | 4/2000 | Cress et al. | 16/240 |
| 6,092,884 | A | 7/2000 | Katz | |
| 2008/0169251 | A1 * | 7/2008 | Smith | 211/26 |

* cited by examiner

*Primary Examiner* — Darnell Jayne
*Assistant Examiner* — Matthew Ing
(74) *Attorney, Agent, or Firm* — Foley & Larnder LLP

(57) ABSTRACT

A cabinet has a cabinet body, a door with at least one support member on a rear side of the door, and at least one hinge pivotally coupling the support member or members to cabinet body. The cabinet body includes framing walls at least partially defining a storage space of the cabinet and a flange disposed laterally outward of an adjacent framing wall. A forwardly-facing surface of the flange is rearwardly offset relative to a front face of the adjacent framing wall. When the door is in a closed position, the support member(s) and the hinge(s) establish a distance between the forwardly-facing surface of the flange and the rear side of the door.

24 Claims, 6 Drawing Sheets

CABINET WITH OFFSET HINGE

CROSS-REFERENCES TO RELATED APPLICATIONS

Not applicable.

BACKGROUND

The present application relates to cabinets. More particularly it relates to improvements in how doors (or other access members) are coupled to such cabinets (e.g., medicine cabinets).

SUMMARY

In one exemplary embodiment, a cabinet has a cabinet body, a door with at least one support member on a rear side of the door, and at least one hinge pivotally coupling the support member or members to cabinet body. The cabinet body includes framing walls at least partially defining a storage space of the cabinet and a flange disposed laterally outward of an adjacent framing wall. A forwardly-facing surface of the flange is rearwardly offset relative to a front face of the adjacent framing wall. When the door is in a closed position, the support member(s) and the hinge(s) establish a distance between the forwardly-facing surface of the flange and the rear side of the door.

When the door is in a closed position, the support member or members may be at least partially received in an area defined generally between the forwardly-facing surface of the flange and the front face of the adjacent framing wall. Likewise, when the door is in the closed position, the rear side of the door may be substantially parallel to the front face of the adjacent framing wall. Each hinge may be coupled to a surface of the support member that is rearwardly-facing.

Each hinge may include at least a first portion and a second portion. The first portion may be at least partially disposed into a recessed portion of the support member and the second portion may be disposed substantially laterally outward relative to the cabinet body. The hinge or hinges may be exterior to the storage space of the cabinet body.

The flange may include a first portion and a second portion. The first portion may be substantially parallel to and spaced a distance from the adjacent side wall. The second portion may be generally parallel to the front face and spaced a distance rearward thereof.

The cabinet may also include another door or doors. If there are two doors, the pair of doors may open away from one another. Regardless of the number of doors, each door may include a forwardly-facing mirror or two mirrors mounted back-to-back.

In another exemplary embodiment, a cabinet has a cabinet body defining a storage space, at least one frameless door coupled to the cabinet body, and at least one hinge. The hinge or hinges include at least a first portion and a second portion. The first portion is at least partially disposed into a recessed portion of the support member or members coupled to a rear surface of the frameless door. The second portion is disposed substantially laterally outward relative to the cabinet body.

In some forms, the frameless door may be a frameless, mirrored door, a frameless, glass door, or a panel of any other rigid material.

The frameless door or doors may be movable relative to the cabinet body between a closed position and an open position. The hinge or hinges may be hidden when the frameless door is in the closed position. The hinge or hinges may be disposed entirely exterior to the storage space when the frameless door is in the open position and when the frameless door is in the closed position. The support member may be disposed generally adjacent to the cabinet body and substantially rearward of a front surface of the cabinet body when the frameless door or doors is/are in the closed position.

The second portion of the hinge(s) may be coupled or positioned relative to a projection, such as a flange, that extends generally laterally outward from the cabinet body. The projection may include a surface offset a distance rearward of a front surface of the cabinet body. The second portion of the hinge(s) may be fixed relative to the surface of the projection.

In still another exemplary embodiment, a cabinet includes a cabinet body defining a storage space, a frameless door pivotally coupled to the cabinet body and movable relative to the cabinet body between a closed position and an open position, at least one support member coupled to a rear side of the frameless door, and at least one hinge. A receiving space is disposed exterior to the storage space and generally rearward of a front surface of the cabinet body. This receiving space at least partially receives the support member or members when the frameless door is in the closed position.

The hinge or hinges may include at least a first portion and a second portion. The first portion may be at least partially disposed into a recessed portion of the support member or members coupled to a rear surface of the frameless door. The second portion may be disposed generally in the receiving space.

A surface may extend generally laterally outward from the cabinet body. The surface may at least partially define the receiving space and help to conceal the hinge or hinges when the frameless door is in the closed position.

Accordingly, the disclosed cabinet has a door attachment structure with a number of possible benefits. As the door can be hinged to the cabinet structure outside of the cabinet box in some embodiments, there is in these embodiments no hinge attachment on the walls of interior of the cabinet box. This provides additional space in the interior volume and does not create an arrangement in which the hinge interferes with items stored on the shelf or in which the hinge interferes with shelf location.

Moreover, in some embodiments, the rear support or "hinge bar" can be mounted to only a single side of the door and nest in a volume or receiving space outside of the cabinet box. In contrast to a door having a frame that extends all the way around the perimeter of the door, this frameless door may have a support only on a single side thereof and, therefore, the door is more lightweight.

This mounting configuration also permits the cabinet to be more compact or to have a low profile as the back side of the door may be flush or nearly flush with the front edge of the cabinet box when the door is closed. By nesting the hinge bar on the side of the cabinet box, the hinges may also be offset from their standard position (i.e., a position on a side wall of the cabinet box). As will be shown in more detail below, this permits the hinges to be substantially concealed when the door is closed, which creates a more pleasing aesthetic appearance.

DETAILED DESCRIPTION

Figure 1:
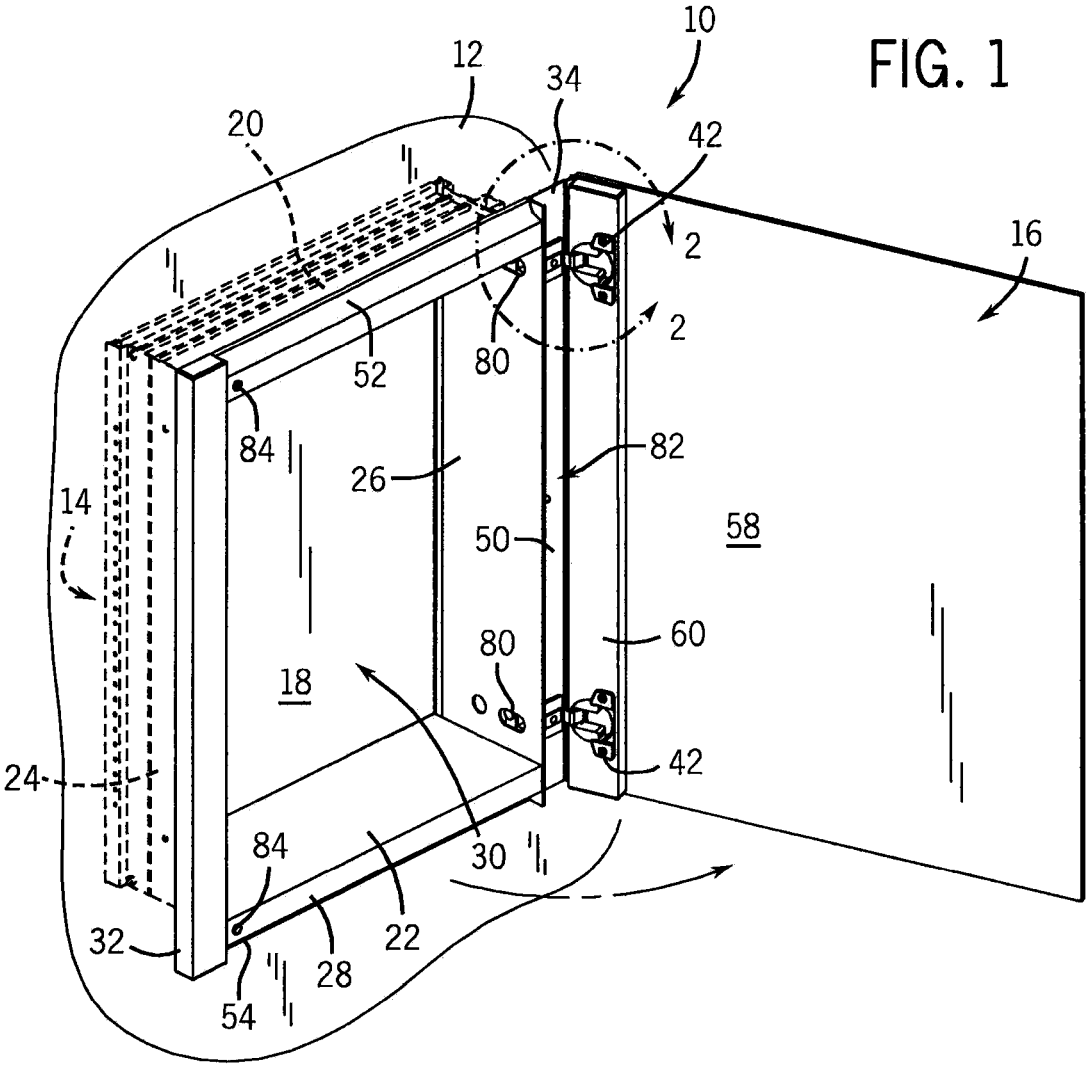
FIG. 1 is a top, frontal, side perspective view of a cabinet according to an exemplary embodiment in which a door of the cabinet is shown in an open position.

Referring first to FIG. 1, a cabinet 10 is shown mounted to a vertical wall 12 (e.g., a bathroom wall) according to an exemplary embodiment. While the cabinet 10 is preferably for use as a medicine cabinet, it may be used to store items for any number of purposes in any number of locations in a home, commercial building, etc. The cabinet may be used as a storage cabinet for any purpose (e.g., a vanity). It should be noted that the cabinet may be adapted to be mounted to any vertical wall or surface.

Figure 4:
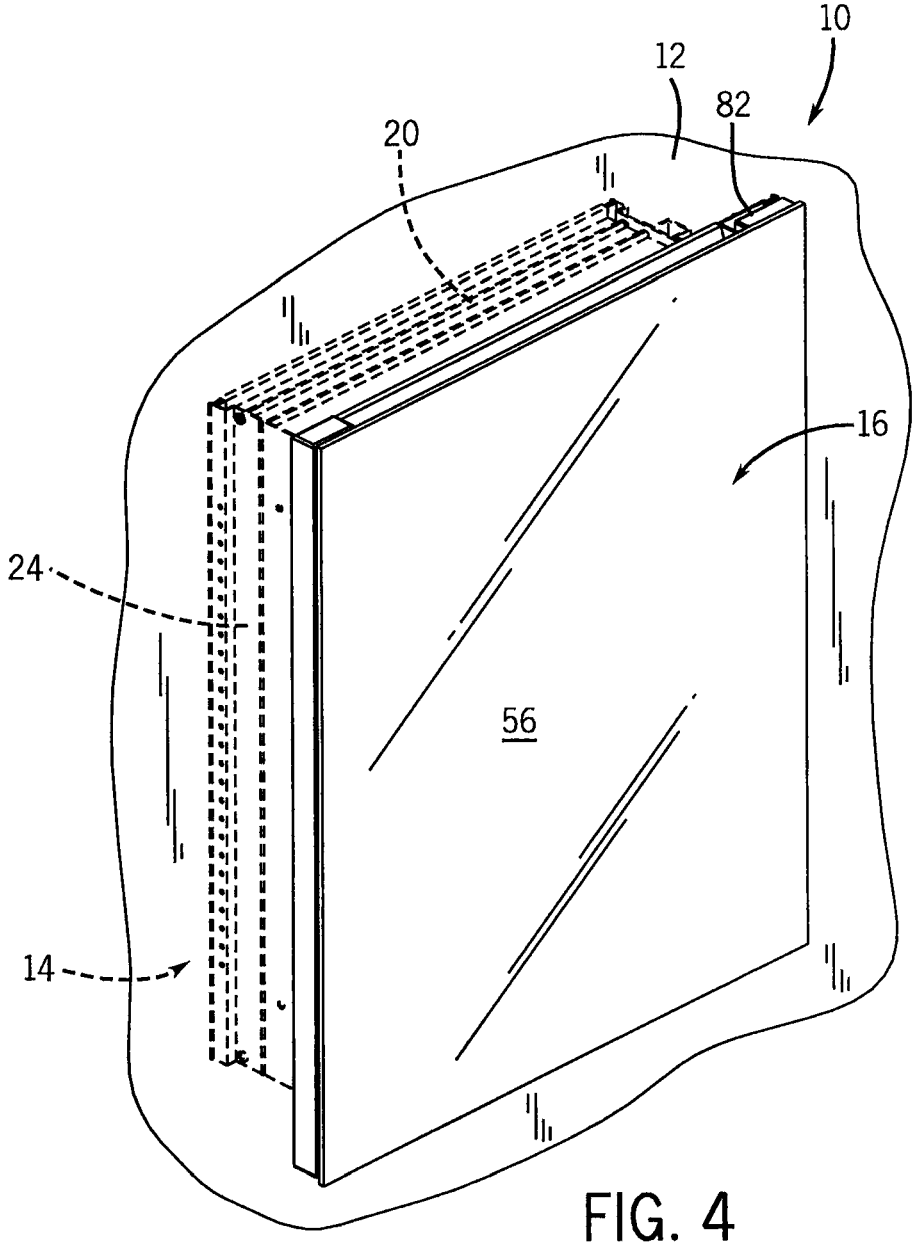
FIG. 4 is a view similar to FIG. 1, but with the door shown in a closed position.
Figure 5:
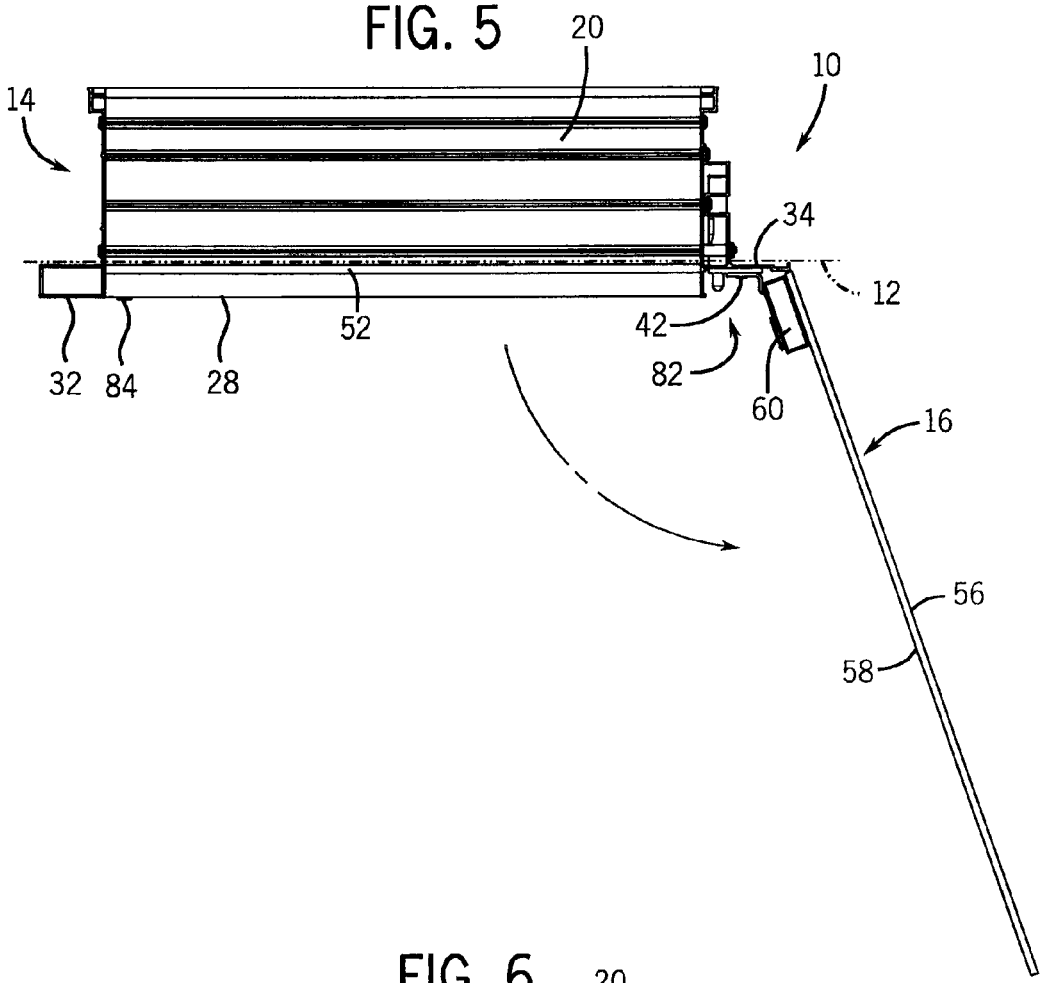
FIG. 5 is a top plan view of the cabinet of FIG. 1.
Figure 6:
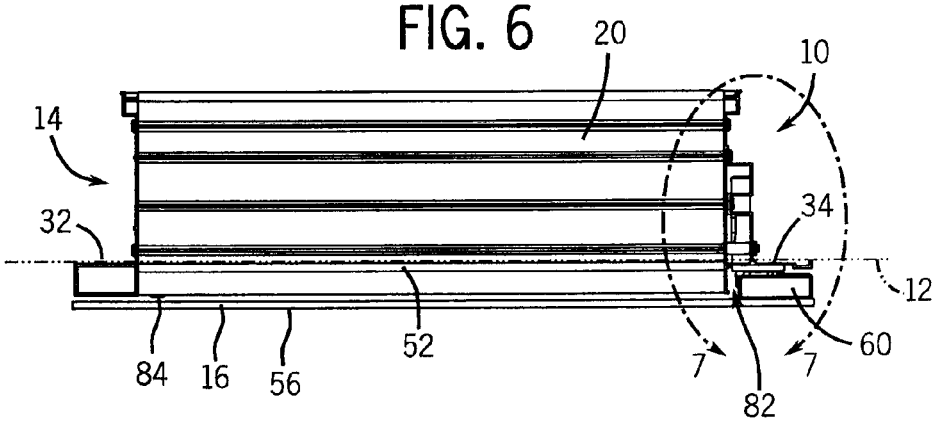
FIG. 6 is a top plan view of the cabinet in FIG. 4.

The cabinet 10 includes a cabinet body 14 and an access element shown as a door 16. The door 16 is coupled to a lateral side of the cabinet body 14 and may be moved relative to the cabinet body 14 between an open position as shown in FIGS. 1 and 5 and a closed position as shown in FIGS. 4 and 6.

Figure 8:
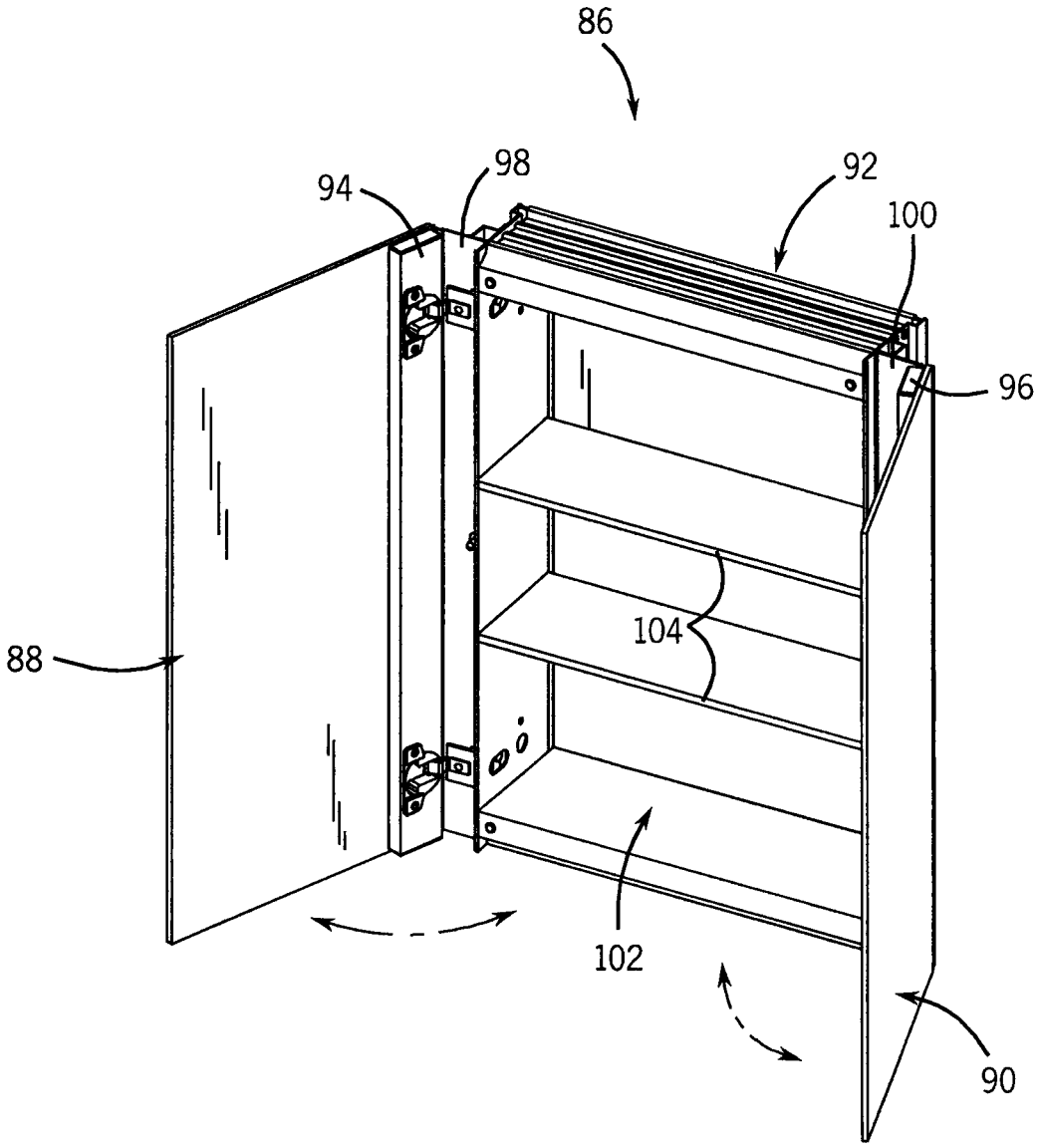
FIG. 8 is another exemplary embodiment of a cabinet in which the cabinet includes two doors.

The cabinet body 14 is shown including a rear wall 18 with framing walls including a top wall 20, a bottom wall 22, and two side or lateral walls 24 and 26 extending generally forward from the rear wall 18 to a front surface or front face 28. These framing walls generally define an inner volume or storage space 30 of the cabinet body 14. The storage space 30 is intended to store and/or conceal items (e.g., goods, etc.) disposed therein. One or more shelves or other storage elements (e.g., hooks, etc.) may be disposed (e.g., mounted, secured, removably coupled, etc.) in the storage space 30 to facilitate storage of items therein (see e.g., FIG. 8 showing shelves 104). In the form shown, the framing walls are separately formed and then attached to one another (e.g., by fasteners such as screws, adhesives, welding, etc.). In other forms, however, one or more of the framing walls may be integrally formed with one another. It should noted that while the cabinet body 14 is shown generally rectangular, the cabinet body may have substantially any shape suitable for defining a space for storing items. Further, the cabinet body may be made of any suitable material, including, but not limited to, wood, plastic, metal, composites, etc.

The cabinet 10 further includes a pair of projections shown as flanges 32 and 34 according to an exemplary embodiment. The flanges 32 and 34 are shown extending generally laterally outward from the two side walls 24 and 26, respectively, of the cabinet body 14 and are generally exterior to the storage space 30 of the cabinet body 14. In the exemplary embodiment shown, the flange 32 is integral with the side wall 24, whereas the other flange 34 is a separate piece (as depicted in the partially exploded view of FIG. 3) and is coupled to the side wall 26 on the exterior side of the side wall 26.

Figure 3:
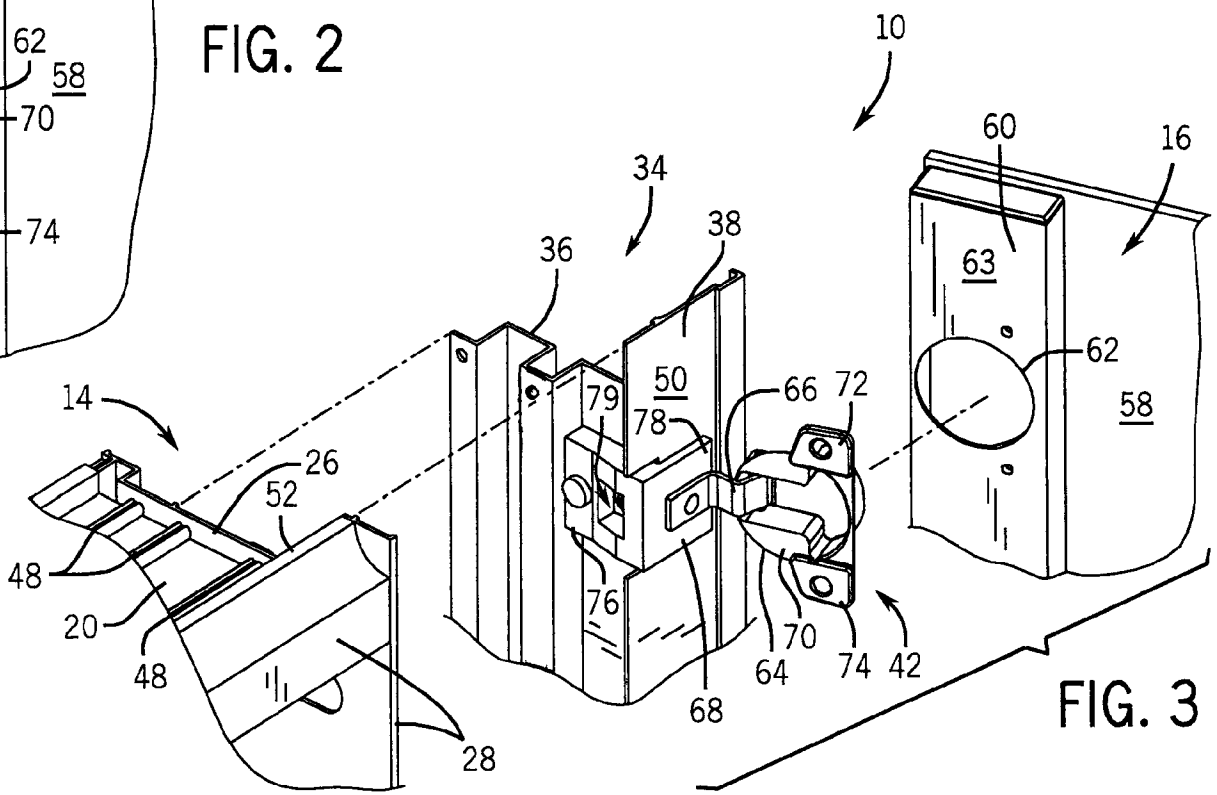
FIG. 3 is a partially exploded view of the detailed view of FIG. 2.
Figure 2:
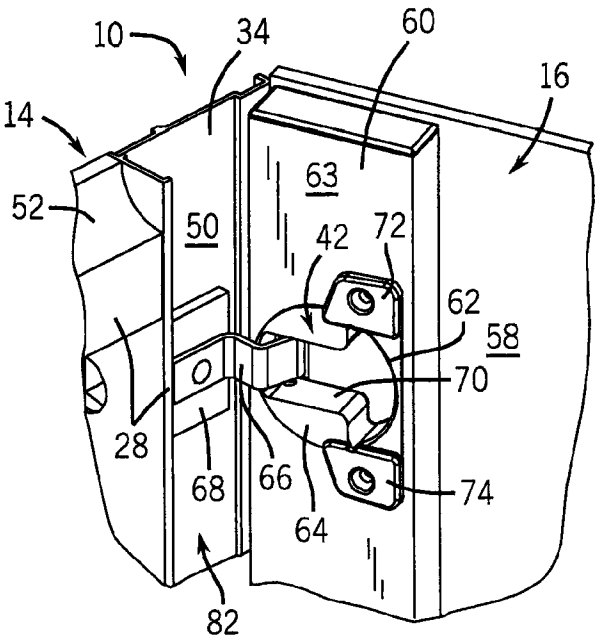
FIG. 2 is a detailed view of the region defined by line 2-2 of FIG. 1.
Figure 7:
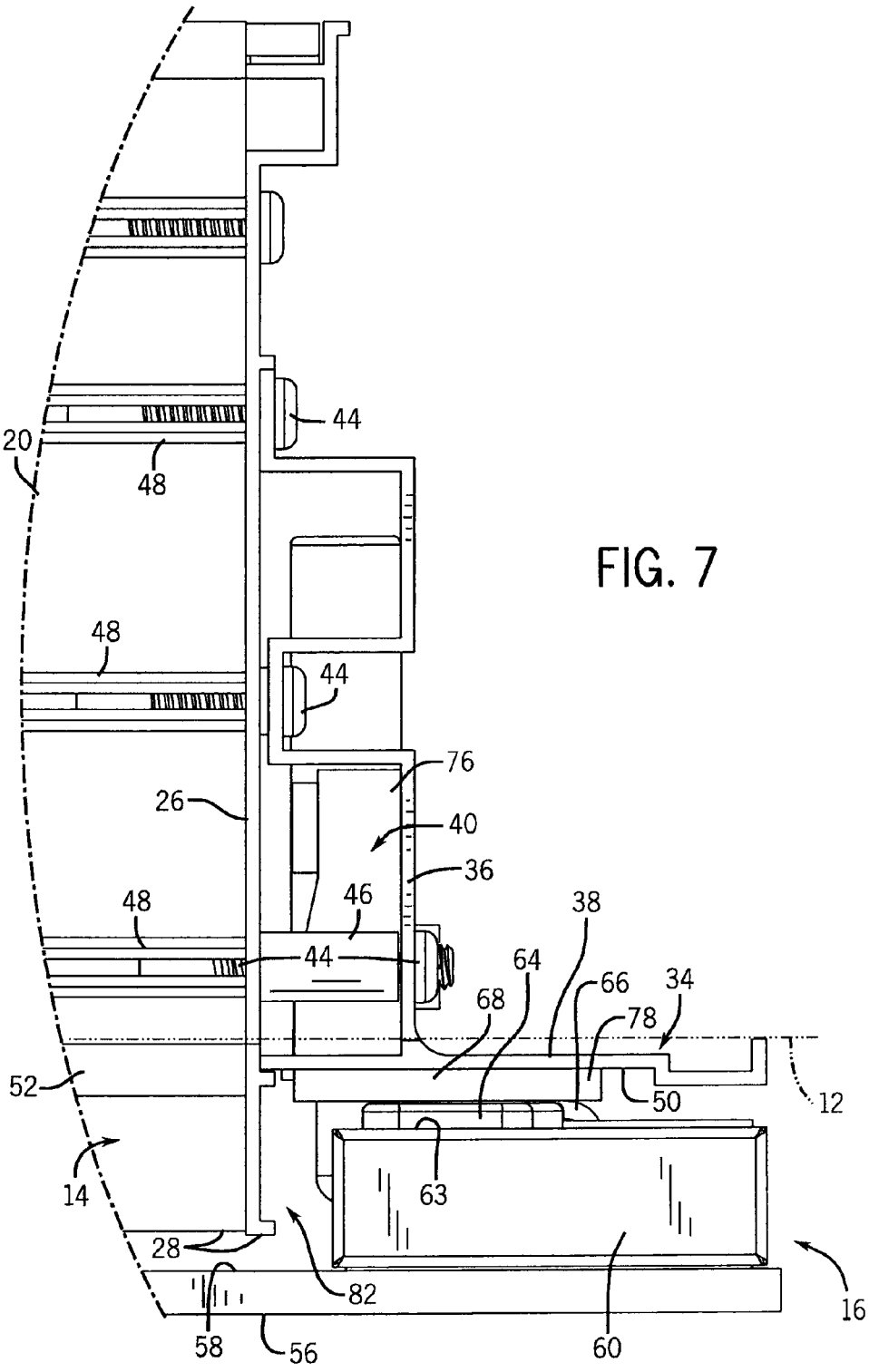
FIG. 7 is a detailed view of the region defined by line 7-7 of FIG. 6.

As best shown in FIGS. 3 and 7, flange 34 is generally L-shaped and includes a first portion 36 for coupling to the exterior side of the side wall 26 and a second portion 38 that is generally perpendicular to the first portion 36 and that projects laterally outward to serve as the flange during installation of the door 16. The first portion 36 includes a number of vertically-extending channels such that, when the first portion 36 is placed against the generally flat exterior surface of the side wall 26, as shown in FIG. 7, a side wall cavity 40 is created that is exterior to storage space 30 and that extends substantially the height of the cabinet body 14. The side wall cavity 40 provides a space into which, in some embodiments, a portion of the hinges 42 may be received and further accommodates adjustment of the hinges 42 to position the door 16 with respect to the cabinet body 14, as will be described in more detail below.

In the exemplary embodiment shown, the first portion 36 of the flange 34 is coupled to the cabinet body 14 using a plurality of fasteners. The fasteners, shown as screws 44 in FIG. 7, are shown extending from the exterior of the first portion 36 of the flange 34 and into the side wall 26 (and, in some instances, through an interposed standoff 46 positioned within the side wall cavity 40). In some exemplary embodiments, the end of the screws 44 may be received in receiving channels (such as the receiving channels 48 in the top wall 20) or captive nuts (e.g., staked into the cabinet body 14), helping to support the flange 34 and/or hinges 42 (as will be discussed in more detail below) relative to a relatively thin face frame wall (e.g., the first portion 38 which is made of aluminum). According to other exemplary embodiments, other suitable methods of coupling the flange (and/or hinge) to the cabinet body may be used.

The second portion 38 of the flange is generally parallel to the front face 28 of the cabinet body 14 and includes a forwardly-facing surface 50 that is substantially parallel to and spaced a distance rearward from the front face 28 of the cabinet body 14 (i.e., is rearwardly offset relative to the front face 28 of the side wall 26). The forwardly-facing surface 50 is disposed adjacent to the side wall 26 and laterally outward thereto (on the right side of the cabinet 10, as viewed from the front).

The cabinet 10 further includes projections shown as flanges 52 and 54 extending outward from the top wall 20 and the bottom wall 22, respectively, and integrally formed therewith. Flanges 52 and 54 along with flanges 32 and 34 are configured to help locate the cabinet 10 relative to the wall 12 and to help hide the edges of the cutout in the wall 12. Referring, for example, to FIGS. 5 through 7, a rearward portion of the framing walls of the cabinet body 14 is shown inserted into a cutout in the wall 12. The back surfaces of flanges 32, 34, 52, and 54, substantially abut the front surface of the wall 12, covering the edges of the cutout while maintaining a relatively low/sleek profile. It should be noted that the projections need not have the same configuration. Further, while potentially desirable for the reason discussed below, projections other than those helping provide for the door to be coupled to the cabinet body need not be present.

Turning now to the structure of the door 16, the door 16 is frameless and generally flat according to an exemplary embodiment. Referring to FIGS. 1 and 4, the door 16 is shown frameless and including a generally planar, flat front surface 56 and a generally planar, flat rear surface 58. One or both of the front surface 56 and the rear surface 58 may be mirrored such that an individual standing in front of the cabinet 10 can see himself or herself in the mirrored surface. In one example embodiment, the door is substantially formed by securing two mirrors back to back. According to other exemplary embodiments, the frameless door may be made of or include glass. According to still other exemplary embodiments, the door may be any generally planar, flat element or may be a panel of any other rigid material.

Referring generally to FIGS. 1 through 7, the cabinet 10 further includes at least one support member 60 (e.g., block, bracket, hinge bar, etc.) coupled (e.g., attached, mounted, adhered, secured, etc.) to the rear surface 58 of the door 16. The support member 60 is shown extending substantially the vertical height of the door 16. The support member 60 may be coupled to the door 16 in any of a number of ways including by adhesives or by fasteners such as, for example, screws. In the exemplary embodiment shown, the support member 60 is adhered to the rear surface 58 of the door 16. It should be noted that the support member 60 may be considered part of the door or independent thereof. It also should be noted that the support member 60 need not be one continuous element, but, rather, may include a number of discrete support members or elements. According to some exemplary embodiments, the support member may be made of wood or could be a hollow rectangular beam, but need not be.

In the exemplary embodiment shown, a number of bores 62 or recessed portions are disposed in a rear surface 63 of the support member 60. As shown, the bores 62 extend generally into the support member 60, which is in the forward direction when the door 16 in the closed position. As will be described in more detail below, the bores 62 are configured to receive a portion of the hinges 42 during assembly of the cabinet 10. In the exemplary embodiment shown, the recessed portions are bores; however, in other exemplary embodiments, the recessed portions may be any kind of pocket, cup, cavity, or so forth and, in some forms, may be sunken and/or concave.

Referring generally to FIGS. 1 through 7, one or more face frame hinges 42 pivotally couple the door 16 to the cabinet body 14 according to an exemplary embodiment. With particular reference to FIGS. 3 and 7, each face frame hinge 42 includes three parts: a door side part 64, an intermediate part 66, and a cabinet body side part 68. The intermediate part 66 links the door side part 64 and the cabinet body side part 68 together.

As best illustrated in FIGS. 3 and 7, the door side parts 64 are disposed at least partially in the bores 62 formed in the support member 60. In the form shown, the door side part 64 includes a body portion 70 and flanged portions 72 and 74 which extend from opposite sides thereof. To install the door side part 64 into the support member 60 of the door 16, the body portion 70 is inserted into a corresponding bore 62 in the support member 60 and the flanged portions 72 and 74 are attached using screws or other fastening elements to the support member 60. It should be noted, however, that other suitable mounting locations/surfaces may be used as will be apparent to one in the art (e.g., the door side part 64 may be coupled to an interior surface of the support member helping define the recessed portion). Further, it should be appreciated that the body portion 70 provides a volume into which the intermediate part 66 may be received when the hinge 42 is in the closed position.

The cabinet body side part 68 is coupled to the flange 34 of the cabinet body 14. The cabinet body side part 68 of the face frame hinge 42 is generally L-shaped having a first leg 76 and second leg 78 according to the shown exemplary embodiment. According to this exemplary embodiment, the first leg 76 of the cabinet body side part 68 is shown disposed substantially within the side wall cavity 40 between the side wall 26 and the first portion 36 of the flange 34. This first leg 76 is secured relative to the side wall 26 via mechanical fasteners (e.g., screws), though other suitable methods of securing this first leg 76 relative to the side wall 26 are contemplated. The second leg 78 is outside of the side wall cavity 40 and extends in front of the forwardly-facing surface 50 of the flange 34. It should be noted that the cabinet body side part 68 need not be L-shaped and the cabinet body side part 68 could be secured relative to the cabinet body 14 in another suitable manner (e.g., mounted directly to the forwardly-facing surface 50 of flange 34, etc.).

In the exemplary embodiment shown, fine positioning of the door 16 relative to the cabinet body 14 may be made by adjustment of the mounting of the cabinet body side parts 68 to the cabinet body 14. More specifically, screws or other fasteners (not shown) are accessible from the storage space 30 of the cabinet body 14 via apertures 80 on the interior side of side wall 26. When the screws are loosened, the cabinet body side part 68 may be repositioned (i.e., translated forward or backward, translated up or down, and/or angled up or down) within a predetermined range of motion established by a counterbored pocket 79 in the first leg 78 as best seen in FIG. 3. Then, upon tightening the screws down, the cabinet body side parts 68 become fixed in position, which in turn establish the position of the door 16 and its range of hinged motion. In the exemplary embodiment depicted, by altering the positions the top and bottom cabinet body side parts 68, the door 16 can be translated up or down relative to the cabinet body 14, translated toward or away from the cabinet body 14, and tilted relative to the cabinet body 14.

Referring now to FIGS. 5 through 7, the thickness of the support member 60 of the door 16 may be great in comparison to the thickness of the rest of the door 16 so that hardware or fasteners used to mount the face frame hinges 42 to the support member 60 will have an adequate amount of material into which to anchor or be received. Moreover, as shown, sections of the support member 60 may be removed if the face frame hinges 42 are of a concealed cabinet hinge type which require at least one-half of the hinge to be sunk into one of the surfaces to which the hinge is attached, although this may not be required for other types of hinges. One having skill in the art will appreciate that other types of hinges other than a concealed cabinet hinge type could also be used in mounting the door 16 to the flange 34, although the particular axis of hinged rotation may be varied by doing so.

When the door 16 of the cabinet 10 is closed, the support member 60 is at least partially received in (e.g. nests, occupies, etc.) a receiving space or area 82. The receiving space or area 82 is shown generally exterior to the cabinet body 14 and at least partially defined by the forwardly-facing surface 50 of the flange 34 and the adjacent side wall 26. Meanwhile, the rest of the door 16, which is shown without any kind of supporting frame, can be substantially flush with or at least have a controlled thin gap with the front face 28 of the cabinet body 14, providing for the cabinet 10 to have a low profile (i.e., does not extend far from the wall 12).

The cabinet 10 may be configured such that there is a controlled gap between the rear surface 58 of the door 16 and the front face 28 of the cabinet body 14 and any such gap, if present, can be controlled by positional adjustment of the hinges 42 as described above. When the door 16 is in a closed position, the support member 60 and the at least one hinge 42 establish a distance between the forwardly-facing surface 50 of the flange 32 and the rear side or rear surface 58 of the door 16. To the extent that this distance exceeds the distance between the forwardly-facing surface 50 and the front face 28, a gap will be formed.

Referring to FIGS. 1, 5 and 6, in the exemplary embodiment depicted, rubbers stops 84 are attached to the front face 28 such that the door 16 is not jarred when the door 16 is closed and the rear surface 58 contacts the front face 28 of the cabinet body 14 according to an exemplary embodiment. Of course, rubber stops 84 or other cushioning elements could also be attached to the rear surface 58 of the door 16. These stops or other cushioning elements may also prompt an increase in the target thickness of the support member 60 or a forward adjustment of the cabinet body side part 68 to account for the increased gap between the front face 28 and the door 16 (as best seen in the top view of FIG. 6) resulting from the added thickness of the cushioning elements.

Referring to FIG. 8, a cabinet 86 is shown having two doors 88 and 90 attached at the two lateral sides of a cabinet body 92 according to another exemplary embodiment. Although not shown in detail in FIG. 8, the two doors 88 and 90 each have a support member 94 and 96 mounted thereon, similar to the door 16 in the cabinet 10 shown in FIGS. 1 through 7. This mounting structure allows for the hinged attachment of the doors 88 and 90 to the rearwardly offset flanges 98 and 100 on each side of the cabinet body 92. Both flanges 98 and 100 are rearwardly offset, so that the support members 94 and 96 can be at least partially received between the side framing walls and the flanges 98 and 100 outside of the inner volume of the cabinet body 92. An inner volume or storage space 102 of the cabinet 86 is shown supporting a plurality of shelves 104.

Thus, a cabinet is disclosed with a new hinge mounting structure. This structure is preferably located entirely outside of the cabinet body and does not occupy any space within the inner volume of the cabinet. This structure also allows the cabinet to have a thin door which reduces the total thickness of the cabinet, the distance the cabinet extends from the wall to which it is mounted, and the overall weight of the cabinet. The support member (e.g., "hinge bar", block, etc.) is received (e.g., recessed or nested) at the side of the cabinet body and, thus, does not substantially increase the thickness of the cabinet. Using this rearwardly offset hinge structure additionally hides the hinge in a location in which the hinge is not readily visible by the end user. It is intended that, only upon swinging the door wide open will the hinge(s) be readily visible.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the cabinet as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A cabinet, comprising:

a cabinet body including framing walls at least partially defining a storage space of the cabinet and a flange disposed laterally outward of an adjacent framing wall, a forwardly facing surface of the flange being rearwardly offset relative to a front face of the adjacent framing wall;

a door with at least one support member on a rear side of the door; and at least one hinge pivotally coupling the at least one support member to the cabinet body such that, when the door is in a closed position, the at least one support member is at least partially received in a receiving space defined between the forwardly facing surface of the flange and a side face of the adjacent framing wall, the second portion having an outer edge spaced from the adjacent framing wall;

wherein the flange includes a first portion that extends rearward and is coupled to the adjacent framing wall, and the flange includes a outer edge, and is substantially parallel to and spaced a distance from the adjacent framing wall that extends laterally away from the first portion to define the forwardly facing surface of the flange;

wherein the first portion of the flange is positioned between the adjacent framing wall and the second portion.

2. The cabinet of claim 1, wherein the rear side of the door is substantially parallel to a front face of the adjacent framing wall when the door is in the closed position.

3. The cabinet of claim 2, wherein the door includes a forwardly-facing mirror.

4. The cabinet of claim 2, wherein the at least one hinge is coupled to a surface of the support member that is rearwardly-facing.

5. The cabinet of claim 1, wherein the at least one hinge includes at least a first hinge portion and a second hinge portion, the first hinge portion being at least partially disposed into a recessed portion of the at least one support member and the second hinge portion being disposed substantially laterally outward relative to the cabinet body.

6. The cabinet of claim 1, wherein the second portion is parallel to the front face and spaced a distance rearward thereof.

7. The cabinet of claim 1, further comprising another door, the pair of doors opening away from one another.

8. The cabinet of claim 1, wherein the at least one hinge is exterior to the storage space of the cabinet body.

9. The cabinet of claim 1, wherein the door includes two mirrors mounted back-to-back.

10. The cabinet of claim 1, wherein the at least one hinge is adjustably mounted relative to the cabinet body.

11. The cabinet of claim 10, wherein the hinge is adjustably mounted such that the door may be moved in a manner consisting of at least one of translation up or down relative to the cabinet body, translation toward or away from the cabinet body, and tilting about a generally horizontal axis toward or away from the cabinet body.

12. The cabinet of claim 1, wherein the hinge is at least partially disposed in a cavity between the first portion of the flange and the adjacent framing wall.

13. A cabinet, comprising:

a storage space defined by a cabinet body comprising a top wall, a bottom wall, and first and second side walls;

at least one frameless door coupled to the cabinet body; and at least one hinge including at least a first hinge portion and a second hinge portion, the first hinge portion being at least partially disposed into a recessed portion of at least one support member coupled to a rear surface of the frameless door, and the second hinge portion being couple to a flange and disposed substantially laterally outward relative to the first side wall, opposite to the storage space;

the flange including a first portion extending rearward and coupled to the first side wall, and a second portion extending laterally away from the first portion to define a forwardly facing surface of the flange, the second portion having an outer edge spaced from the first side wall; wherein the first portion of the flange is positioned between the first side wall and the outer edge, and is substantially parallel to and spaced a distance from the first side wall;

wherein at least part of the second hinge portion is in the recessed portion when the door is in a closed position and out of the recessed portion when the door is in an open position.

14. The cabinet of claim 13, wherein the at least one frameless door is one of a frameless, mirrored door or a frameless, glass door.

15. The cabinet of claim 13, wherein the at least one frameless door is movable relative to the cabinet body between the closed position and the open position, the at least one hinge being hidden when the at least one frameless door is in the closed position.

16. The cabinet of claim 15, wherein the at least one hinge is disposed entirely exterior to the storage space when the at least one frameless door is in the open position and when the at least one frameless door is in the closed position.

17. The cabinet of claim 15, wherein the support member is disposed adjacent to the cabinet body and substantially rearward of a front surface of the cabinet body when the at least one frameless door is in the closed position.

18. The cabinet of claim 13, wherein the second hinge portion is coupled to a projection extending laterally outward from the cabinet body.

19. The cabinet of claim 18, wherein the projection includes a surface, the surface being offset a distance rearward of a front surface of the cabinet body, the second hinge portion being fixed relative to the surface of the projection.

20. The cabinet of claim 13, wherein the first hinge portion includes at least one flanged portion coupled to a rear surface of the support member.

21. The cabinet of claim 13, wherein the at least one support member is adhered to a substantially flat rear surface of the at least one frameless door.

22. A cabinet, comprising:

a cabinet body having at least one wall and defining a storage space;

a frameless door pivotally coupled to the cabinet body and movable relative thereto between a closed position and an open position;

at least one support member coupled to a rear side of the frameless door;

a flange including a first portion extending rearward and coupled to the wall, and a second portion extending laterally away from the first portion to define a forwardly facing surface of the flange, the second portion having an outer edge spaced from the wall; wherein the first portion of the flange is positioned between the wall and the outer edge, and is substantially parallel to and spaced a distance from the wall;

a receiving space exterior to the storage space and rearward of a front surface of the cabinet body, and at least partially defined by the forward facing surface of the flange, the receiving space at least partially receiving the support member when the frameless door is in the closed position; and at least one hinge;

wherein the hinge is coupled to the support member and the cabinet body, and a pivot axis of the hinge is arranged forward of a rear side of the at least one support member.

23. The cabinet of claim 22, wherein the at least one hinge includes at least a first hinge portion and a second hinge portion, the first hinge portion being at least partially disposed into a recessed hinge portion of the at least one support member coupled to a rear surface of the frameless door, and the second portion being disposed generally in the receiving space.

24. The cabinet of claim 23, further comprising a surface extending laterally outward from the cabinet body, the surface at least partially defining the receiving space and helping conceal the at least one hinge when the frameless door is in the closed position.

* * * * *

UNITED STATES PATENT AND TRADEMARK OFFICE

CERTIFICATE OF CORRECTION

PATENT NO. : 8,480,189 B2
APPLICATION NO. : 12/965634
DATED : July 9, 2013
INVENTOR(S) : Howard S. Katz et al.

It is certified that error appears in the above-identified patent and that said Letters Patent is hereby corrected as shown below:

In the Claims

Column 8, lines 36-38, delete “, the second portion having an outer edge spaced from the adjacent framing wall”.

Column 8, line 44, insert --, the second portion having an outer edge spaced from the adjacent framing wall-- immediately after “flange” and before the “;”.

Column 8, lines 41-43, delete “outer edge, and is substantially parallel to and spaced a distance from the adjacent framing wall” and replace it with --second portion--.

Column 8, line 46, delete “second portion” and replace it with --outer edge, and is substantially parallel to and spaced a distance from the adjacent framing wall--.

Column 9, line 23, delete “couple” and replace it with --coupled--.

Column 10, line 45, delete “hinge”.

Column 10, line 47, insert --hinge-- between “second” and “portion”.

Signed and Sealed this
Second Day of June, 2015

Michelle K. Lee

Michelle K. Lee
*Director of the United States Patent and Trademark Office*